US006308956B1

(12) United States Patent
Reid

(10) Patent No.: US 6,308,956 B1
(45) Date of Patent: Oct. 30, 2001

(54) BALL AND LADDER GAME

(76) Inventor: Robert G. Reid, 632 Evergreen St., Emmaus, PA (US) 18049

( * ) Notice: Subject to any disclaimer, the term of this patent is extended or adjusted under 35 U.S.C. 154(b) by 0 days.

(21) Appl. No.: 09/442,608

(22) Filed: Nov. 18, 1999

(51) Int. Cl.[7] ..... A63B 67/00
(52) U.S. Cl. ..... 273/343
(58) Field of Search ..... 273/343, 401; 473/514

(56) References Cited

U.S. PATENT DOCUMENTS

| | | | | |
|---|---|---|---|---|
| 2,797,924 | * | 7/1957 | Stewart | 273/343 |
| 3,701,531 | * | 10/1972 | Bowers | 273/343 |
| 3,717,348 | * | 2/1973 | Bowers | 273/343 |
| 4,487,419 | * | 12/1984 | Welbourn | 273/343 |
| 5,165,694 | * | 11/1992 | Kraushaar | 273/343 |
| 5,522,597 | * | 6/1996 | Hanks | 273/343 |

* cited by examiner

*Primary Examiner*—Mark S. Graham
(74) *Attorney, Agent, or Firm*—Sanford J. Piltch

(57) ABSTRACT

A tethered ball toss game is described in which a number of tethered balls arranged at both ends of a series of cords and secured to the ends of the cords by knots are tossed from a prescribed distance toward a number of horizontal bars positioned between upright supports which are retained in perpendicular angularity to the underlying support surface by bottom supports. Each of the horizontal bars are relocatable in a vertical direction along the side supports to other pre-determined points for engagement with the side supports by engaging a retractable latching member into a cooperating hole so that the bar is secured in the desired position. In this fashion the distance between the bars can be altered to vary the difficulty and skill levels of the game. Alternative embodiments of the game are also contemplated where the length of the bars is varied by changing the shape of the side supports to accommodate shortened horizontal bars. This different array of bars can be progressively shorter from bottom to top, or vice versa, or have shorter bars at the middle of the vertical distance.

7 Claims, 3 Drawing Sheets

BALL AND LADDER GAME

BACKGROUND OF THE INVENTION

The invention resides in the field of games involving the tossing of an article toward an object in order to score points by having the article engage one or more appendages or supports of the object.

The basic concept of tossing an article toward an object is the game of horseshoes, or a later modification, quoits. This involves the throwing, or tossing, of a ring or horseshoe to engage an upright stake anchored into the ground. The stake may be anchored at a perpendicular angle to the surface of the ground, or at any other angle suitable for a variant of the basic game. The object of the game is to encircle the stake with the horseshoe or ring, the ring being the more difficult due to a lack of an opening.

Other articles have been utilized to be tossed at objects, i.e., targets, such as beanbags and weights tied at the ends of short cords. However, in most instances, these articles are used with targets which require the placement of the article within the target, rather than around or hanging from the target. The present invention relies upon the latter, the use of balls tied at the ends of short cords, for tossing at a series of parallel bars arranged one above the other with scoring being gauged upon the skill difficulty of tossing the tied balls onto or over a designated bar.

It is, therefore, an object of the present invention to provide a series of substantially horizontal bars, arrayed one atop the other having an adjustable space between each set of the bars, such that one or more sets of tethered balls can be tossed toward any of the bars to be engaged over or onto a selected bar.

It is also an object of the present invention to provide supports which hold the array of bars such that the available length of any of the bars can be altered, shortened or lengthened, in accordance with the varying of the shape of the supports so that the target areas are, likewise, shortened and lengthened.

It is another object of the present invention to allow for the placement of the bars in one vertical array and permit the adjustment of the placement of the bars into another vertical array utilizing the same supports in order to vary the distance between the bars to increase or decrease the level of skill and difficulty in engaging the tethered balls over or onto the one of more horizontal bars.

Other objects will appear hereinafter.

SUMMARY OF THE INVENTION

The present invention is a tethered ball toss game in which a number of tethered balls arranged at both ends of a series of cords and secured to the ends of the cords by knots are tossed from a prescribed distance toward a number of horizontal bars position between upright supports which are retained in perpendicular angularity to the underlying support surface by bottom supports. Each of the horizontal bars are relocatable in a vertical direction along the side supports to other pre-determined points for engagement with the side supports by engaging a retractable latching member into a cooperating hole so that the bar is secured in the desired position. In this fashion the distance between the bars can be altered to vary the difficulty and skill levels of the game.

Alternative embodiments of the game are also contemplated where the length of the bars is varied such as by changing the shape of the side supports to accommodate shortened horizontal bars. This different array of bars can be progressively shorter from bottom to top, or vice versa, or have shorter bars at the middle of the vertical distance.

A ball toss game for throwing tethered balls at a target is described comprising a pair of upright side supports retained in perpendicularity to an underlying support surface by respective bottom supports, a plurality of bar tossing members positioned between said upright supports which are removeably engaged at pre-determined points in a vertical direction along said side supports, said bar tossing members being releasably engaged by one or more retractable latching members in like dimensioned latching member receiving apertures located at the pre-determined points along the side supports and a pair of spheroids arranged at each of the ends of a plurality of elongated flexible cords and secured to said ends of the respective cords by passing the cords through a centrally located aperture in each spheroid and knotting the cords on either side of each spheroid tethering the pair of spheroids to each other with a pre-determined length of cord therebetween. With this equipment, the plurality of tethered spheroids are tossed from one or more prescribed distances at the bar tossing members in order to temporarily secure the tethered spheroids over said bar tossing members scoring points for those tethered spheroids remaining temporarily secured over said bar tossing members at the end of a series of tosses by a number of players.

The length of the bar tossing members between the side supports may be varied to increase or decrease the level of difficulty and skill in temporarily securing the tethered spheroids over the bar tossing members. One such example may be the bar tossing members arranged in progressively shorter lengths from bottom to top, or the bar tossing members arranged in progressively longer lengths from bottom to top. Another example may be the bar tossing members arranged with shorter lengths at the middle of the vertical direction along said side supports, or the bar tossing members arranged with longer lengths at the middle of the vertical direction along said side supports.

Further, the distance between the bar tossing members may be varied to increase or decrease the level of difficulty and skill in temporarily securing the tethered spheroids over the bar tossing members. Other variations of the game will be described more fully hereinafter.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
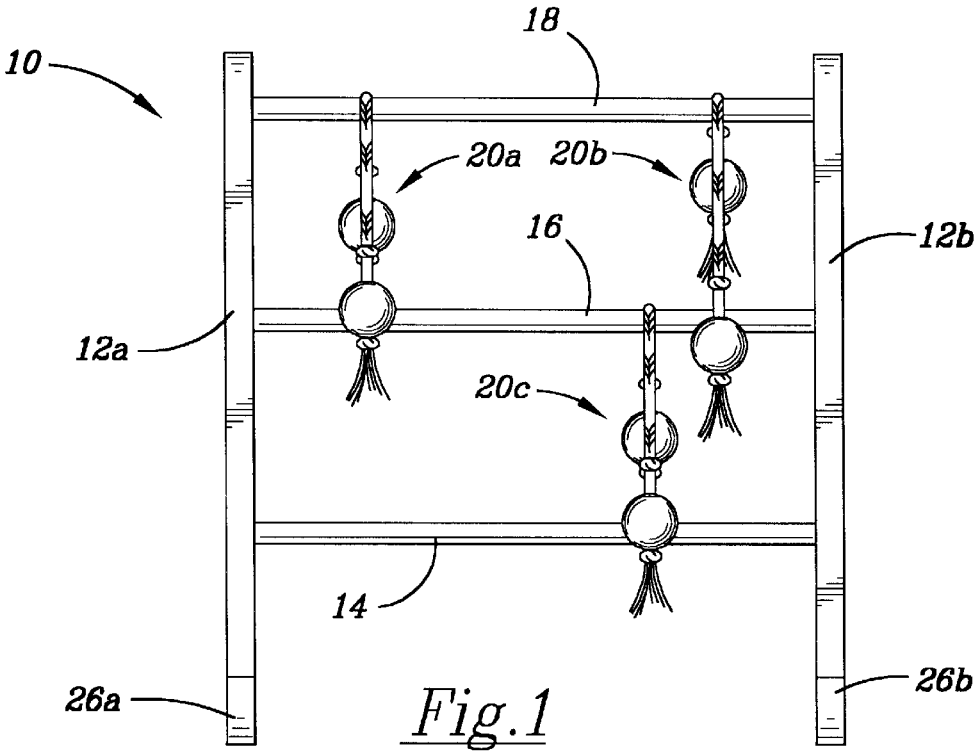
FIG. 1 is a front view of the ball and ladder game of the present invention.

Referring now to the drawings in detail, where like numerals refer to like parts or elements, there is shown in FIG. 1 the tethered ball toss game structure 10 of the present invention. The tethered ball toss 10 is provided with a pair of side supports 12*a*, 12*b* which are arranged (as shown in FIG. 1) at a uniform distance from one another. Each of the side supports 12*a*, 12*b* have a series of holes 22 in which respective ends 24 of each of the horizontal bars 14, 16 and 18. [See FIG. 1A]. The distance d between the respective holes 22 in each of the side supports 12*a*, 12*b* may vary to increase or decrease the skill and difficulty level as described in more detail below. At the lowest point of the side supports 12*a*, 12*b* are a pair of bottom supports 26*a*, 26*b* which provide integral support for the side supports 12*a*, 12*b* so that the side supports are held in a perpendicular angular relationship to the bottom supports 26*a*, 26*b* which rest upon the underlying surface.

Figure 1A:
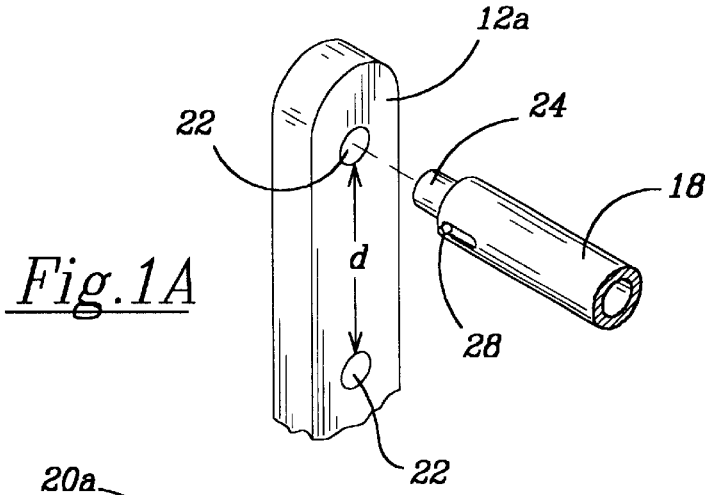
FIG. 1A is a partial perspective view of the interconnection between the horizontal catching rods and the upright supports of FIG. 1.
Figure 2:
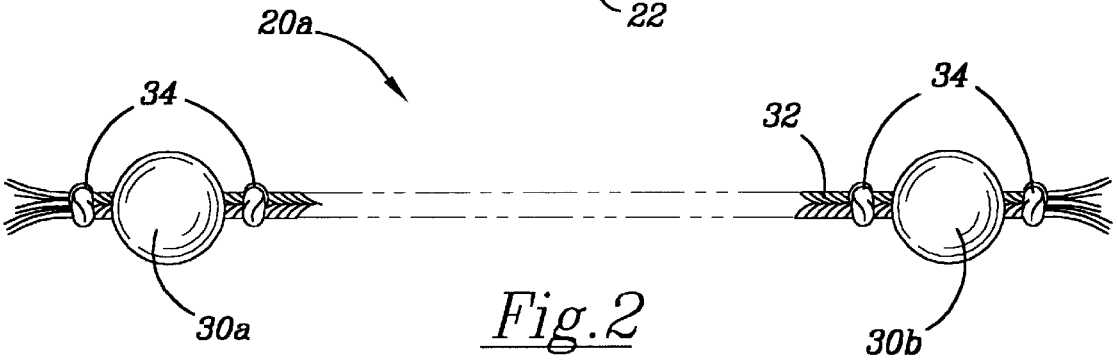
FIG. 2 is a view of one set of tethered balls of the present invention.
Figure 3:
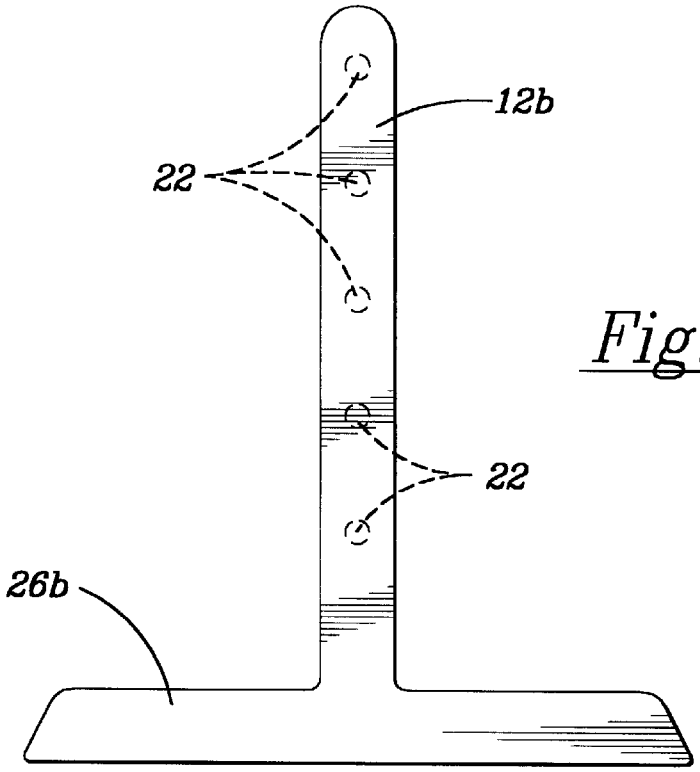
FIG. 3 is a side view of the ball and ladder game of the present invention.
Figure 4:
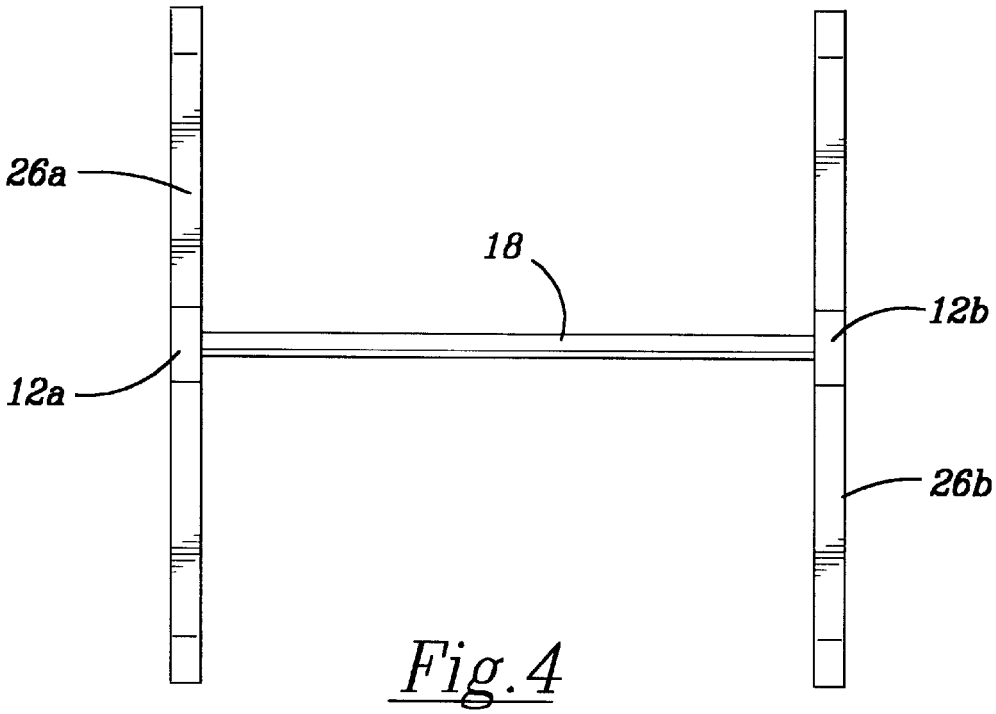
FIG. 4 is a top view of the ball and ladder game of the present invention.

With particular reference to FIGS. 1, 1A and 3, the bars 14, 16 and 18 are adjustably mounted into holes 22 through the engagement of retractable end 24. Each of the bars may be vertically moved within the space between the side supports 12*a*, 12*b* when the space is of uniform width. To accomplish the relocation of a bar 16, a retractable latch or slide release 28, which pulls the end 24 of the bar 16 back into the hollow space within the bar, is actuated to disengage the end 24 from the cooperating hole 22 permitting the bar to be removed from the supports 12*a*, 12*b*. To relocate the bar, one end 24 is placed within a cooperating hole 22 in one side support 12*b*, and the other end 24 is retracted using release 28 until that end is positioned over the cooperating hole 22 of side support 12*a* and released to engage the side support. This procedure is used to move, or relocate, any of the horizontal bars 14, 16 or 18 from one position to another position as may be desired for increasing or decreasing skill and difficulty levels to tossing the tethered balls. With specific reference to FIG. 3, the holes 22 are presented as being exemplary of a number of varying locations arrayed along the vertical dimension of the side support 12*b* to show the locations (holes 22) where any bar may be placed. While these holes 22 are shown equidistant from each other, this may not necessarily be the only arrangement and holes may be non-uniformly spaced so that the distance d may not be identical in all forms of the game.

Returning to FIG. 1, the tethered ball toss 10 shown is depicting a horizontal bar array having equally spaced bars 14, 16 and 18 located in the top, middle and bottom holes 22 (as shown in FIG. 3). This array leaves the intermediate holes without any bar engaged, but also allows for the relocation of any bar to those unoccupied holes 22. The distance d between any two of the bars can be changed as described and directly relates to the level of skill and difficulty of the ball toss and, consequently, scoring of the game.

The tethered balls 20*a*, 20*b* and 20*c*, as shown in FIG. 1, are capable of engaging any of the bars 14, 16 or 18 by hanging over the bar. The tethered balls 20*a* can be described as two balls 30*a*, 30*b* which are tied into their respective positions at each end of a cord 32 by a series of knots 34. The balls 30*a*, 30*b* and the knots 34 are located proximate the respective ends of the cord 32 with a variable length of cord between them. The length of the cord 32 between the balls 30*a*, 30*b* may be of any length suitable to allow the balls 30*a*, 30*b* to act as weights and drape over any bar as shown in FIG. 1. The balls 30*a*, 30*b* also act as a restraint to the disengaging of the tethered balls 20 from any of the bars 14, 16 or 18 by falling off due to the weight of one or the other of the balls.

Figure 5:
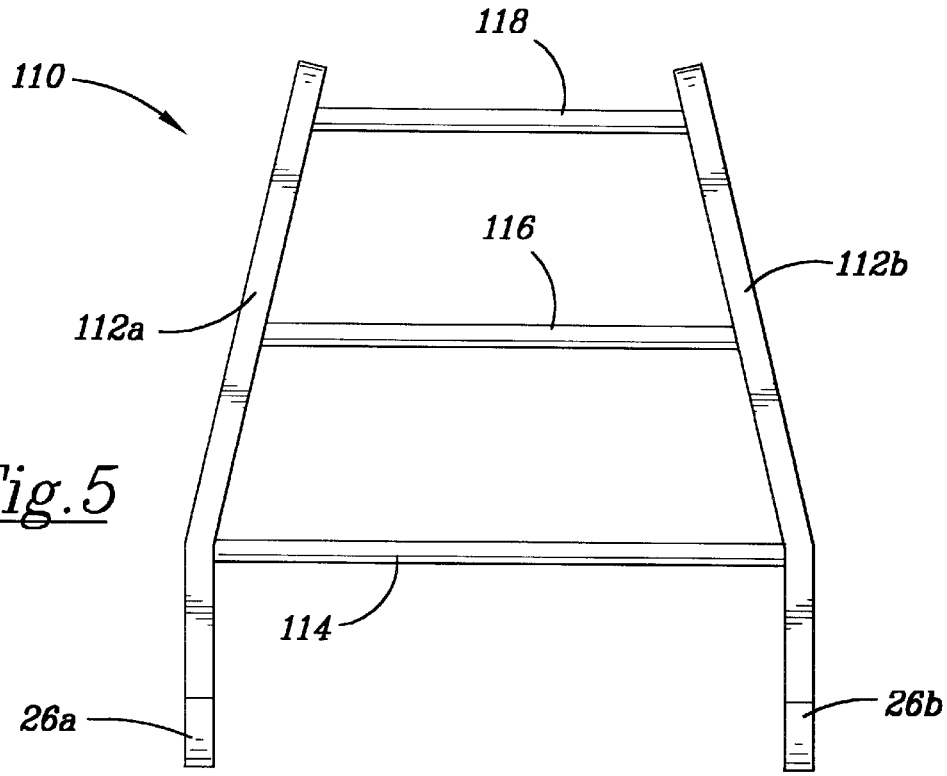
FIG. 5 is a first alternate embodiment of the ball and ladder game of the present invention.
Figure 6:
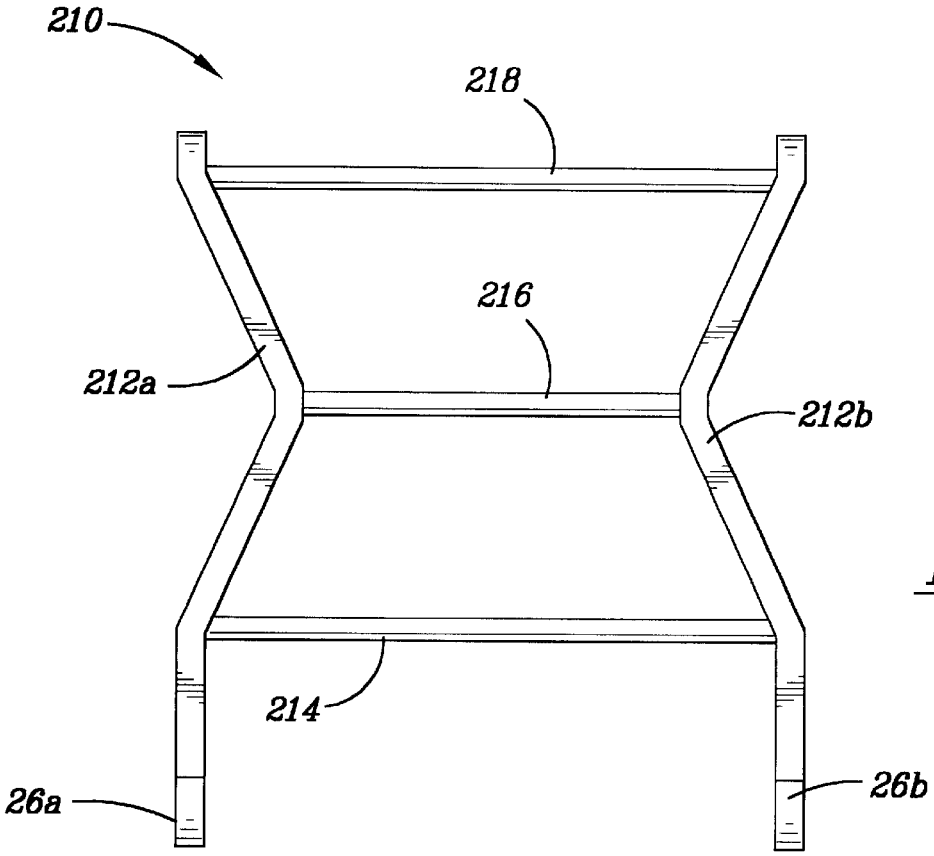
FIG. 6 is a second alternate embodiment of the ball and ladder game of the present invention.

Alternate embodiments of the invention are shown in FIGS. 5 and 6. For the tethered ball toss 110 of FIG. 5, instead of each of the side supports, which remain perpendicular to the bottom supports 26*a*, 26*b*, being parallel to each other, the side supports 112*a*, 112*b* are shaped to approach each other as they extend upward, closing the distance between each of the supports. This results in the shortening of the bars 114, 116 and 118 as the bars are placed higher in the ball toss 110. The shortening of the length of the bars 114, 116 and 118 serves to increase the skill and difficulty levels of tossing the tethered balls 20 onto the bars having a shortened length.

For the tethered ball toss 210 of FIG. 6, the side supports 212*a*, 212*b* are shaped to approach each other toward the middle of the vertical dimension of these supports which shortens the length of the middle bar 216 as against the length of the upper and lower bars 218 and 214, respectively. As in the case of the first alternative embodiment, the skill and difficulty levels are increased as the length of the middle bar 216 is shortened and the side supports 212*a*, 212*b* bend inward reducing the available space for engaging any of the tethered balls 20 onto or over the bars. For this embodiment, the upper and lower bars 218 and 214 may be relocated to positions closer to the middle bar if the shape of the side supports 212*a*, 212*b* permits. In the embodiment shown in FIG. 6, the lower bar 214 may be relocated downward, away from the middle bar 216, increasing the distance d between the respective bars as described in connection with FIG. 3.

The tethered ball toss game is played by standing a prescribed distance from the tethered ball toss 10 and throwing or tossing the tethered balls 20 toward the bars 14, 16 and 18 in order to have the tethered balls 20 engage, by draping over, any of the bars as described above. Each of the bars 14, 16 and 18 may be relocated (as described in regard to FIG. 3) to increase the skill or difficulty level of the game by increasing or decreasing the distance d between any of the bars 14, 16 or 18. Engagement of the tethered balls 20 with each of the bars 14, 16 or 18 earns the thrower an amount of difficulty or skill points, e.g. five (5) points for engaging the bottom bar 14, ten (10) points for engaging the top bar 18, and fifteen (15) points for engaging the middle bar 16. Likewise, point differentials may be utilized for relocated bars, or for the alternative embodiments having shortened bar lengths. The object of the game is to achieve a certain point value in the fewest number of tosses or throws.

The tethered ball toss 10, 110 or 210 is preferred to have linear dimensions of 20 to 30 inches for the length of the bottom supports 26 and the length of the bars 14, 16 and 18 and 30 to 36 inches for the height of the side supports 12 to afford sufficient space for relocating the horizontal bars in accordance with the present invention. Further, the tethered ball toss 10, 110, 210 has separable elements so that the various supports and bars can be packaged as individual members and assembled for game use.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

I claim:

1. A ball toss game for throwing tethered balls at a target comprising:

a. a pair of upright side support members retained in perpendicularity to an underlying support surface by respective bottom support members;

b. a plurality of bar tossing members positioned between said upright support members which are removeably engaged at pre-determined points in a vertical direction along said side support members, said bar tossing members being releasably engaged by one or more retractable latching members in like dimensioned latching member receiving apertures located at said pre-determined points along the side support members; and c. a pair of spheroids arranged at each of the ends of a plurality of elongated flexible cords and secured to said ends of the respective cords by passing the cords through a centrally located aperture in each spheroid and knotting the cords on either side of each spheroid tethering the pair of spheroids to each other with a pre-determined length of cord therebetween, whereby the plurality of tethered spheroids are tossed from one or more prescribed distances at the bar tossing members in order to temporarily secure the tethered spheroids over said bar tossing members scoring points for those tethered spheroids remaining temporarily secured over said bar tossing members at the end of a series of tosses by a number of players.

2. The ball toss game of claim 1, wherein the length of the bar tossing members between the side support members is varied to increase or decrease the level of difficulty and skill in temporarily securing the tethered spheroids over the bar tossing members.

3. The ball toss game of claim 2, wherein the bar tossing members are arranged in progressively shorter lengths from bottom to top.

4. The ball toss game of claim 2, wherein the bar tossing members are arranged in progressively longer lengths from bottom to top.

5. The ball toss game of claim 2, wherein the bar tossing members are arranged with shorter lengths at the middle of the vertical direction along said side support members.

6. The ball toss game of claim 2, wherein the bar tossing members are arranged with longer lengths at the middle of the vertical direction along said side support members.

7. The ball toss game of claim 1, wherein the distance between the bar tossing members may be varied to increase or decrease the level of difficulty and skill in temporarily securing the tethered spheroids over the bar tossing members.

* * * * *